United States Patent [19]

Young

[11] 4,090,705

[45] May 23, 1978

[54] JUMP ROPE

[76] Inventor: Ross Young, 5404 S. Bishop, Chicago, Ill. 60609

[21] Appl. No.: 779,867

[22] Filed: Mar. 21, 1977

[51] Int. Cl.[2] ..... A63B 5/20

[52] U.S. Cl. ..... 272/75; 46/177

[58] Field of Search ..... 272/74, 75, 67, 68, 272/116, 122, 123, 124, 143; 46/47, 51, 52, 174, 175 R, 175 AR, 177, 191, 193; 273/58 E, 58 F, DIG. 20; 116/169, 170

[56] References Cited

U.S. PATENT DOCUMENTS

| | | | |
|---|---|---|---|
| 85,514 | 1/1869 | Cross | 272/75 |
| 148,489 | 3/1874 | Murphy | 272/75 |
| 498,753 | 5/1893 | Tucker | 272/75 |
| 906,303 | 12/1908 | Sapper | 272/75 |
| 1,668,143 | 5/1928 | Daasch | 273/58 E |
| 2,509,810 | 5/1950 | Core, Jr. | 272/122 |
| 2,612,135 | 9/1952 | Iny | 116/170 |
| 2,719,038 | 9/1955 | Massa | 272/75 |

FOREIGN PATENT DOCUMENTS

| | | | |
|---|---|---|---|
| 524,531 | 5/1931 | Germany | 272/123 |
| 164,848 | 9/1958 | Sweden | 272/75 |
| 21,299 of | 1894 | United Kingdom | 273/58 E |
| 578,539 | 2/1946 | United Kingdom | 46/193 |
| 1,043,017 | 9/1966 | United Kingdom | 272/75 |

*Primary Examiner*—Richard J. Apley
*Assistant Examiner*—Arnold W. Kramer
*Attorney, Agent, or Firm*—Bernard L. Kleinke

[57] ABSTRACT

A jump rope includes a flexible line having a pair of handles attached to the ends thereof for being grasped by the hands of the user. A flexible hollow member is disposed on the line, and is attached to the line for fixing it thereto midway between the handles so that as the user is skipping rope, the flexible hollow member engages the ground to facilitate the continued skipping operation. The handles are hollow, and small particles are disposed within the handles and within the flexible hollow member to provide a rhythmical rattling sound as the user is skipping rope.

5 Claims, 3 Drawing Figures

FIG. 1
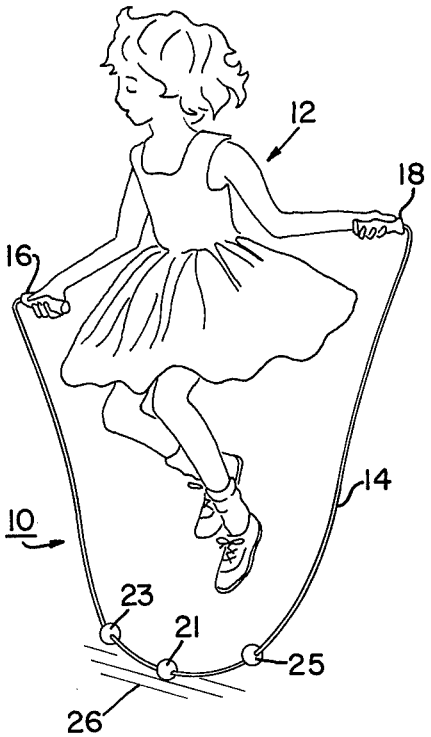
FIG. 2
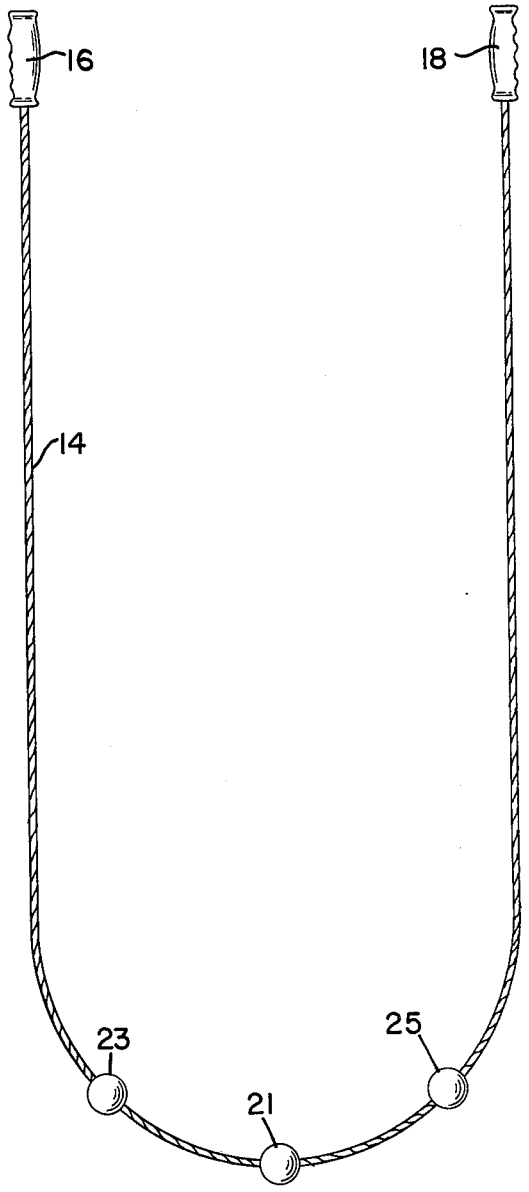
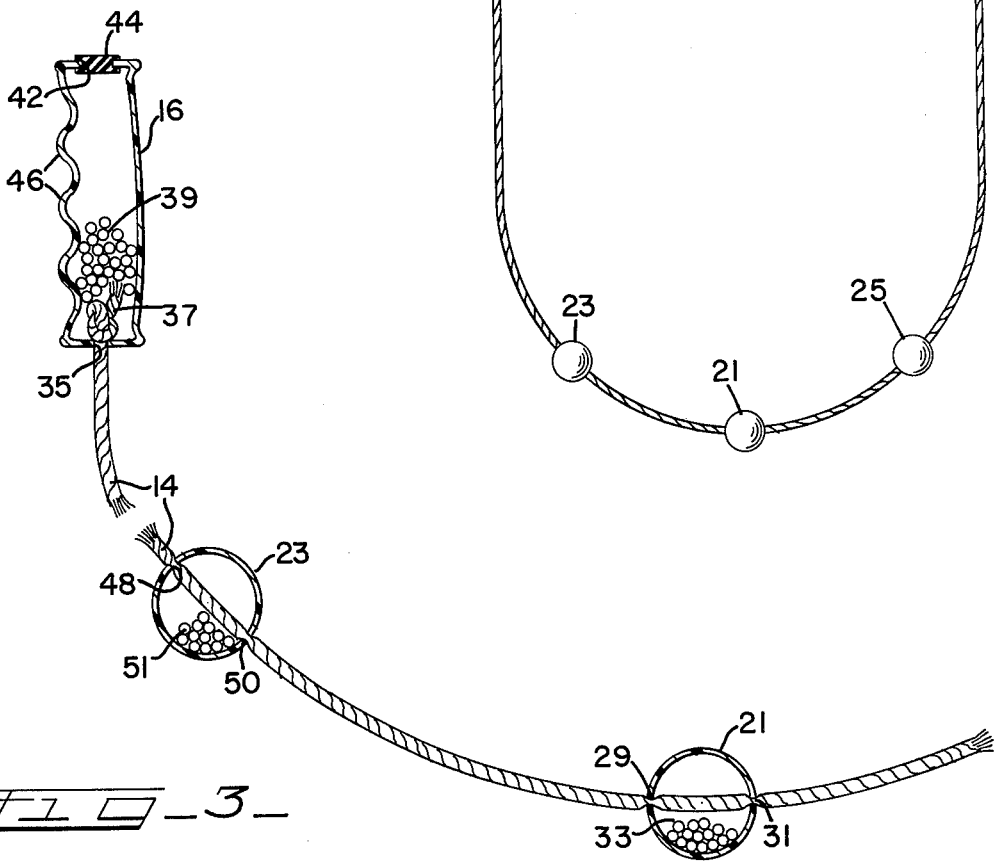
FIG. 3

JUMP ROPE

The present invention relates in general to a jump rope, and it more particularly relates to a jump rope which is used for skipping rope for entertainment and for exercising purposes.

In the past, jump ropes have been used for entertainment purposes and for exercising purposes. They generally include a flexible line having a pair of handles at opposite ends thereof. As is well known, the user grasps the handles and commences rotating the flexible line about the body of the user who continuously jumps over the line as it approaches the feet of the user. In this manner, the user can continue skipping the rope. However, once a substantial portion of the intermediate portion of the flexible line strikes inadvertently the ground, the rhythm of the user is interrupted and the skipping operation terminates. It would be highly desirable to have a jump rope which would overcome the problem of the flexible line striking the ground and thus interrupting the skipping operation. Such a jump rope would enable the user to continue uninterruptedly a skipping sequence for much longer periods of time. Also, it would be highly desirable to have such a jump rope which also produces musical sounds to facilitate the maintaining of the rhythm of the user during a jumping operation.

Thus, the principal object of the present invention is to provide a new and improved jump rope, which facilitates the uninterrupted skipping operation, and which is relatively inexpensive to manufacture.

Another object of the present invention is to provide such a new and improved jump rope, which also produces rhythmical sounds for facilitating and maintaining the rhythm of the user as the user is performing a skipping operation.

Briefly, the above and further objects of the present invention are realized by providing a new and improved jump rope, which includes a flexible line having a pair of handles attached to the ends thereof for being grasped by the hands of the user. The jump rope includes a flexible hollow member disposed on the line and attached thereto midway between the handles for engaging the ground during the jumping operation to enable the user to continue the skipping operation in an uninterrupted manner for longer periods of time. A plurality of hard small particles are disposed within the hollow flexible handles, and within the hollow member to provide a rattling or rhythmical sound during a skipping operation.

The invention, both as to its organization and method of operation, together with further objects and advantages thereof, will best be understood by reference to the following detailed description taken in connection with the accompanying sheet of drawings, wherein:

FIG. 1 is a pictorial view of a jump rope, which is constructed in accordance with the present invention and which is illustrated in the process of being used;

FIG. 2 is an enlarged plan view of the jump rope of FIG. 1; and

FIG. 3 is an enlarged cross-sectional fragmentary view of the jump rope of FIG. 2.

Referring now to the drawings, and more particularly to FIG. 1 thereof, there is shown a jump rope 10, which is constructed in accordance with the present invention and which is shown in the process of being used by a person 12. The jump rope 10 generally comprises a flexible line 14 having a pair of hollow handles 16 and 18 attached to the ends of the line 14, whereby the handles 16 and 18 may be grasped by the hands of the user 12. A flexible hollow ball 21 is disposed on the line 14 and is attached to it midway between the ends of the line 14. A pair of decorative hollow rattle balls 23 and 25 are also fixed to the line 14 on opposite sides of and near the hollow ball 21.

In use, the user 12 grasps the handles 16 and 18 in each hand, and then commences skipping the jump rope 10. The flexible hollow member or ball 21 is adapted to strike the ground 26 (FIG. 1) as the hollow member 21 swings downwardly to the lowermost portion of its path of travel. Thus, the hollow member 21 slides along the ground 26 and bounces therefrom to facilitate the continued uninterrupted skipping of the rope 10 by the user 12. The user 12 may choose not to permit the resilient member 21 to strike the ground 26, but if it should inadvertently contact the ground 26 during the jumping operation, the resilient member 21 enables the user 12 to continue the jumping operation in an uninterrupted manner since the striking of the ground 26 does not inhibit the skipping operation.

Considering now the hollow member or ball 21 in greater detail with reference to FIG. 3 of the drawings, the hollow member or ball 21 is spherical in shape and is composed of suitable resilient material, such as a flexible plastic material or rubber. A pair of diametrically-opposed holes 29 and 31 in the flexible hollow member 21 receives the line 14 which extends therethrough to thread the hollow member 21 thereon. The diameter of the holes 29 and 31 are slightly smaller than the diameter of the line 14 to snugly retain the member 21 in position midway between the handles 16 and 18.

A plurality of small hard particles or beads 33 are disposed within the interior of the hollow member 21 to provide a rhythmical rattling sound as the jump rope 10 is being used. This rattling sound is useful for entertainment purposes, and it also helps to establish the rhythm of the user 12 to further facilitate the uninterrupted skipping operation.

A line 14 may be composed of any suitable flexible material, such as a Nylon cord or rope. Considering now the handles in greater detail, the handle 16 will now be considered, the handle 18 being similar to the handle 16 and thus will not be described in any greater detail. The handle 16 is hollow and is generally cylindrical in configuration. A hole 35 in the lower end portion thereof receives the end portion of the line 14, and the line 14 is retained within the interior of the hollow handle 16 by means of a knot 37 or other similar stop device.

A plurality of hard particles or beads 39 are disposed within the interior of the handle 16 to provide a rattling sound in a similar manner as the particles 33 make within the resilient member 21.

An access opening 42 enables the particles 39 to be placed within the hollow interior of the handle 16, and a plug 44 seals over the opening 42.

The handle 16 is preferably composed of molded plastic material, and has a series of finger recesses 46.

Considering now the hollow ball or hollow member 23 in greater detail with reference to FIG. 3 of the drawings, the hollow member 23 is generally similar to the member 25 which need not be described in greater detail. The member 23 is generally spherical in shape and has a pair of diametrically-opposed holes 48 and 50 for receiving the line 14 between the resilient hollow member 21 and the handle 16. The diameter of holes 48 and 50 are less than the diameter of the line 14 to provide a very snug fit to fix it in position of the line 14.

A plurality of hard particles or beads 57 are disposed within the ball 23 for rattling purposes in a similar manner as the beads 33 are disposed within the ball 21. The balls 23 and 25 are for decorative purposes to provide an aesthetically pleasing appearance, and they also provide additional rhythmical sound to facilitate the rope skipping operation. The balls 23 and 25 are preferably composed of plastic material.

Therefore, in view of the foregoing description, it will become apparent to those skilled in the art that the foregoing described jump rope is novel in construction and enables one to continue skipping a rope in an uninterrupted manner. Such a jump rope is substantially and patentably different from conventional jump ropes, such as those disclosed in U.S. Pat. Nos. 498,753; 1,371,915; 2,919,919 and 3,064,971.

While the present invention has been described in connection with a particular embodiment thereof, it will be understood that many changes and modifications of this invention may be made by those skilled in the art without departing from the true spirit and scope thereof. Accordingly, the appended claims are intended to cover all such changes and modifications as fall within the true spirit and scope of the present invention.

What is claimed is:

1. A jump rope comprising:

a flexible line;

a pair of handles attached to the ends of the line for being grasped by the hands of the user, each one of said handles being hollow;

a flexible hollow member disposed on said line, said flexible member being spherical in shape;

attaching means for fixing said hollow member to said line midway between said handles;

a first plurality of hard small particles disposed within the hollow handles for rattling therewithin;

a second plurality of hard small particles disposed within said flexible hollow member for rattling therewithin;

a second hollow member fixed to said line at one side of the first-mentioned hollow member, a third plurality of hard small particles being disposed within the second hollow member to produce a rattling sound during use of the jump rope; and a third hollow member fixed to the line at the other side of the first-mentioned hollow member, said second and third hollow members being spaced by equal distances from the first-mentioned hollow member, a third plurality of hard small particles disposed within the third hollow member for rattling therewithin.

2. A jump rope according to claim 1, wherein each one of said handles includes a series of finger recesses to facilitate gripping same by the hand of the user.

3. A jump rope according to claim 2, wherein each one of said hollow handles includes an access opening to permit its hard small particles to be placed therein, further including a plug sealing over said opening.

4. A jump rope according to claim 3, wherein each one of said handles includes a hole for receiving an end portion of said flexible line, a knot tied in said end portion of said line fixing it to and disposed within the hollow interior of its handle.

5. A jump rope according to claim 4, wherein each one of said handles is composed of molded plastic material.

* * * * *